US009476170B2

(12) United States Patent
MacNeil et al.

(10) Patent No.: US 9,476,170 B2
(45) Date of Patent: Oct. 25, 2016

(54) SHIELDING SYSTEM FOR HYDRODEMOLITION APPARATUS

(71) Applicant: MAC & MAC HYDRODEMOLITION INC., Surrey (CA)

(72) Inventors: Gerard J. MacNeil, Surrey (CA); David B. MacNeil, Surrey (CA); Gordon MacNeil, Surrey (CA); Vernon Bose, Surrey (CA); Jesse MacNeil, Surrey (CA); Brett MacNeil, Surrey (CA); Edward van Gool, Surrey (CA)

(73) Assignee: MAC & MAC HYDRODEMOLITION INC. (CA)

( * ) Notice: Subject to any disclaimer, the term of this patent is extended or adjusted under 35 U.S.C. 154(b) by 0 days.

(21) Appl. No.: 14/884,639

(22) Filed: Oct. 15, 2015

(65) Prior Publication Data

US 2016/0222606 A1 Aug. 4, 2016

(30) Foreign Application Priority Data

Jan. 22, 2015 (CA) ..... 2879311

(51) Int. Cl.
*E01C 23/12* (2006.01)
*B05B 3/14* (2006.01)
*B05B 13/00* (2006.01)

(52) U.S. Cl.
CPC ..... *E01C 23/128* (2013.01); *B05B 3/14* (2013.01); *B05B 13/005* (2013.01)

(58) Field of Classification Search
CPC ..... E01C 23/128; B05B 13/005
USPC ..... 299/16, 17; 239/288, 288.3, 288.5, 239/DIG. 8, 104, 120; 451/451, 453, 457; 241/285.1, 285.2, 285.3; 83/397, 83/397.1, 860; 144/251.1; 409/134, 254
See application file for complete search history.

(56) References Cited

U.S. PATENT DOCUMENTS 1,161,774 A * 11/1915 Connell et al. ..... B27G 19/02 83/397
1,551,900 A * 9/1925 Morrow ..... B23Q 11/0082 144/251.1
1,649,194 A * 11/1927 Ross ..... B26D 3/14 83/397
4,096,789 A * 6/1978 Blessinger ..... B23Q 11/0866 144/251.1
4,753,549 A * 6/1988 Shook ..... E01C 23/128 175/424
4,793,734 A * 12/1988 Shook ..... B05B 3/02 175/424
4,854,770 A * 8/1989 Puchala ..... E01C 23/128 299/17
4,890,567 A * 1/1990 Caduff ..... B05B 13/005 114/222
4,909,111 A * 3/1990 Noble ..... B23Q 9/0078 269/303
5,429,162 A * 7/1995 Bonnett ..... B27C 5/02 144/135.2
5,551,813 A * 9/1996 Bonnett ..... B23Q 11/0046 144/251.2

(Continued)

*Primary Examiner* — Sunil Singh
(74) *Attorney, Agent, or Firm* — Matthew A. Pequignot; Pequignot + Myers LLC

(57) ABSTRACT

A shield system for a hydrodemolition apparatus has a loop whose ends are secured to opposite sides of a reciprocating nozzle carrier. The loop may be supported by a supporting structure surrounding the frame along which the nozzle carrier reciprocates. The loop overlays portions of one or more gaps through which one or more nozzles extend to work an underlying surface. The nozzles have access to the underlying surface through the gaps under the nozzle carrier, but the balance of the gaps are covered by the loop which is drawn or pushed by the nozzle carrier during reciprocation.

4 Claims, 8 Drawing Sheets

(56) References Cited

U.S. PATENT DOCUMENTS 5,918,522 A * 7/1999 Benedict ..... B27G 19/02 83/397
6,010,570 A * 1/2000 Motoda ..... B05B 15/0208 118/302
6,024,147 A * 2/2000 Hunter, Jr. ..... B05B 13/005 118/323
6,036,123 A * 3/2000 West ..... B05B 13/005 118/305
6,953,303 B1 * 10/2005 Chase ..... E01C 23/128 299/17
7,396,195 B2 * 7/2008 Chang ..... F16P 1/00 144/251.1
2011/0081479 A1 * 4/2011 Morris, Jr. ..... B05B 1/28 427/136
2015/0368920 A1 * 12/2015 MacNeil ..... E04G 23/081 299/17

* cited by examiner

SHIELDING SYSTEM FOR HYDRODEMOLITION APPARATUS

RELATED APPLICATION DATA

This application claims priority to Canadian Patent Application No. 2,879,311, filed Jan. 22, 2015. All claims of priority to this application are hereby made, and this application is hereby incorporated in its entirety by reference.

FIELD OF THE INVENTION

This invention relates to hydrodemolition apparatus. In particular the invention relates to hydrodemolition apparatus used to work surfaces such as bridge decks, roads and runways.

BACKGROUND OF THE INVENTION

FIGS. 1, 2 and 3 illustrate a prior art hydrodemolition apparatus 10 for removing materials from horizontal surfaces. A nozzle carrier 12 is mounted within a laterally-extending, generally rectangular frame 14 to reciprocate transversely (16) to the direction of the direction of travel 18 of the machine. Reciprocation of the nozzle carrier 12 is along frame members 22, 24 of the frame 14. Nozzles 26, 28, 30 extend downward from the nozzle carrier 12 through gaps 32, 34, 36 between laterally-extending elongated base frame members 38, 40, 42, 44 to work the underlying road or deck surface. The front 46 and sides 48 of the frame extend down to near contact with the surface such that there is little opportunity for debris to escape from those sides. The rear of the frame is covered with a skirt 50 to prevent the scattering of debris through the gap created between the bottom of the frame and the partially excavated surface.

The presence of a gap between the frame members to accommodate the movement of the nozzles as the nozzle carrier reciprocates transversely provides a means for debris to be ejected vertically through the gaps for those portions of the gaps not otherwise covered for the time being by the nozzle carrier itself. It is therefore known in the prior art to provide elongated rubber slats 52, 54, 56, 58, 60, 62 extending lengthwise of the frame between the gaps. They are secured by retention plates 64, 66, 68, 70. The sides of the slats meet or overlap slightly (as at 72) over the gaps to close the gaps except where a nozzle protrudes through the adjoining slats. The adjoining slats form elongated slots 74, 76, 78 overlying the elongated gaps 32, 34, 36. Despite that, debris is still occasionally ejected from the slot presenting a danger to surrounding equipment and personnel.

It is an object of this invention to further reduce the opportunity for debris to be ejected vertically through the gap in the frame members.

These and other objects of the invention will be better understood by reference to the detailed description of the preferred embodiment which follows. Note that the objects referred to above are statements of what motivated the invention rather than promises. Not all of the objects are necessarily met by all embodiments of the invention described below or by the invention defined by each of the claims.

SUMMARY OF THE INVENTION

In its broadest aspect, the invention comprises a loop extending from one side of a nozzle carrier, along a carrier frame and looping back over the nozzle carrier to the opposite side of the nozzle carrier, the belt moving in response to movement of the nozzle carrier.

In another aspect, the invention is a shield system for a hydrodemolition apparatus that comprises a frame having at least one gap therein, a nozzle carrier mounted for reciprocation along the frame and at least one nozzle extending from the nozzle carrier through the gap. The shield system comprises a loop extending from one side of the nozzle carrier, over the nozzle carrier and to an opposite side of the nozzle carrier. A first end of the loop is secured directly or indirectly to the one side of said nozzle carrier and an opposite end of the loop is secured to the opposite side of the nozzle carrier. The loop is otherwise unrestrained such that displacement of the nozzle carrier along the frame draws or pushes the portions of the loop that are secured to the nozzle carrier along the direction of displacement. The loop is of a material or materials having dimensions to completely cover the portions of the gap that are not covered by the nozzle carrier during reciprocation of the nozzle carrier.

The loop may comprise a belt having a width sufficient to completely cover the portions of the gap that are not covered by the nozzle carrier during reciprocation of the nozzle carrier.

In another aspect, the frame may comprise several adjacent gaps and the loop may comprise a belt having a width sufficient to completely cover the portions of the adjacent gaps that are not covered by the nozzle carrier during reciprocation of the nozzle carrier.

In yet another aspect, the invention is a shield system for a hydrodemolition apparatus comprising a frame having at least two adjacent gaps in the frame, a nozzle carrier mounted for reciprocation along the frame, and at least one nozzle extending downward from the nozzle carrier through each of the adjacent gaps. The shield system comprises a belt loop extending from one side of the nozzle carrier, over the nozzle carrier and to an opposite side of the nozzle carrier. A first end of the belt is secured to the one side of said nozzle carrier and an opposite end of the belt is secured to the opposite side of the nozzle carrier, movement of the belt being otherwise unrestrained such that displacement of the nozzle carrier along the frame draws or pushes the portions of the belt that are secured to the nozzle carrier along the direction of displacement. The belt is of a width sufficient to completely cover the portions of the gaps that are not covered by the nozzle carrier during reciprocation of the nozzle carrier.

The foregoing may cover only some of the aspects of the invention. Other aspects of the invention may be appreciated by reference to the following description of at least one preferred mode for carrying out the invention in terms of one or more examples. The following mode(s) for carrying out the invention is not a definition of the invention itself, but is only an example that embodies the inventive features of the invention.

BRIEF DESCRIPTION OF THE DRAWINGS

The preferred mode for carrying out the invention in terms of one or more examples will be described by reference to the drawings thereof in which.

DETAILED DESCRIPTION OF AT LEAST ONE MODE FOR CARRYING OUT THE INVENTION IN TERMS OF EXAMPLE(S)

Figure 1:
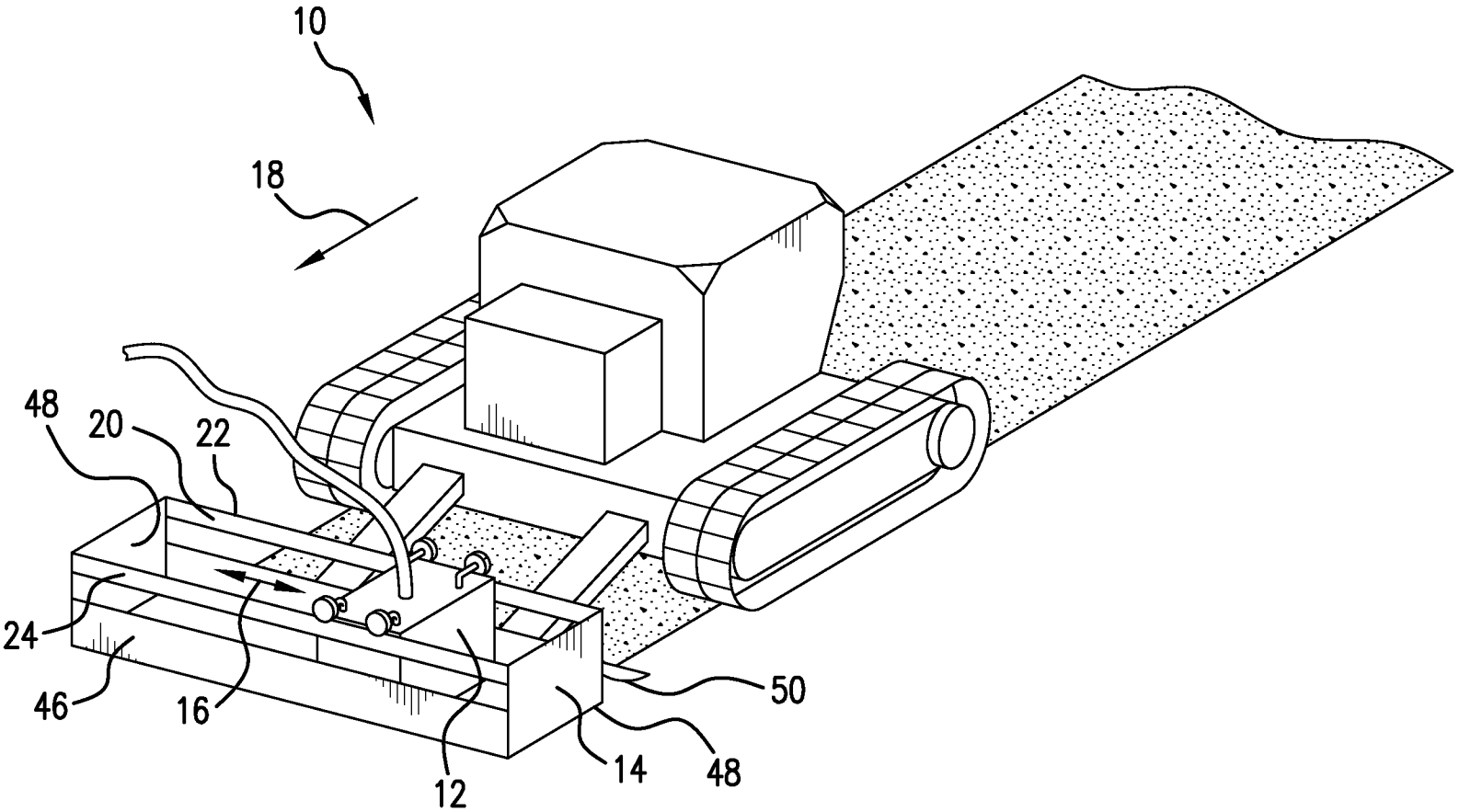
FIG. 1 Prior Art
FIG. 1 is a perspective view of a prior art deck hydrodemolition apparatus.
Figure 2:
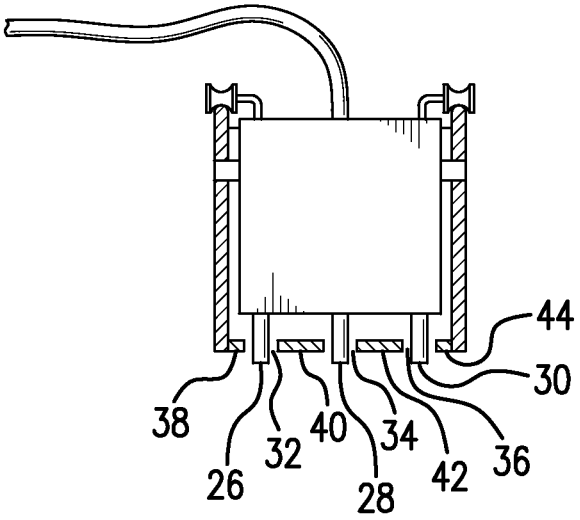
FIG.2 Prior Art
FIG. 2 is a side sectional view of the frame and nozzle carrier according to the prior art apparatus of FIG. 1, but without rubber slats to cover the gaps between base frame members.
Figure 3:
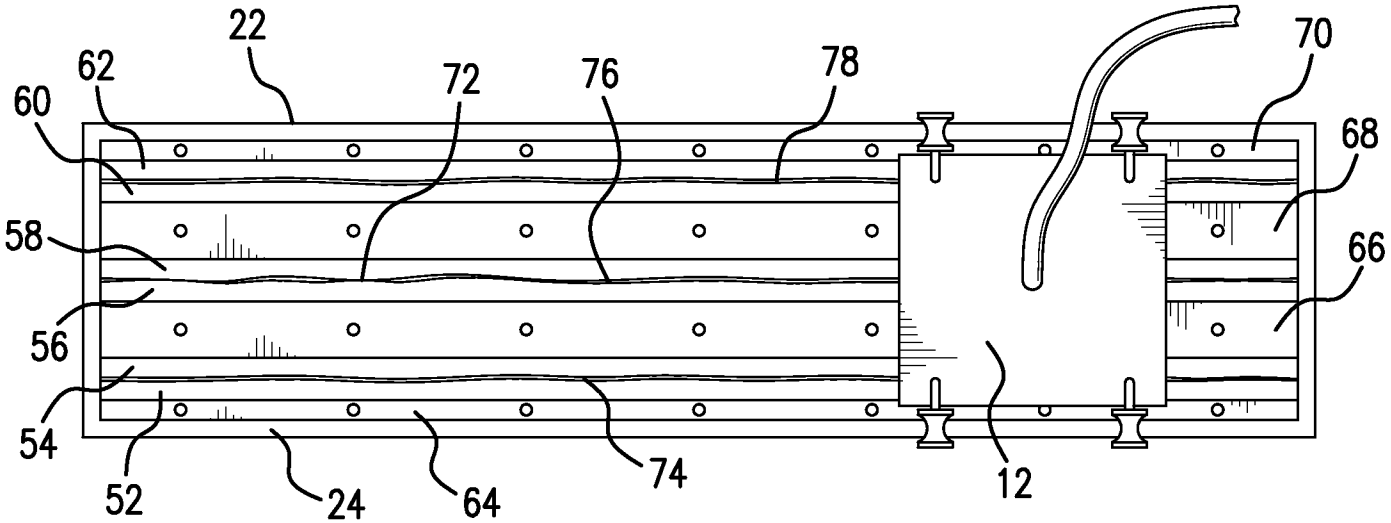
FIG. 3 Prior Art
FIG. 3 is a plan view of the frame and nozzle carrier of the prior art apparatus of FIG. 1 showing the rubber slats used to cover the nozzle gaps in the base frame members.
Figure 4:
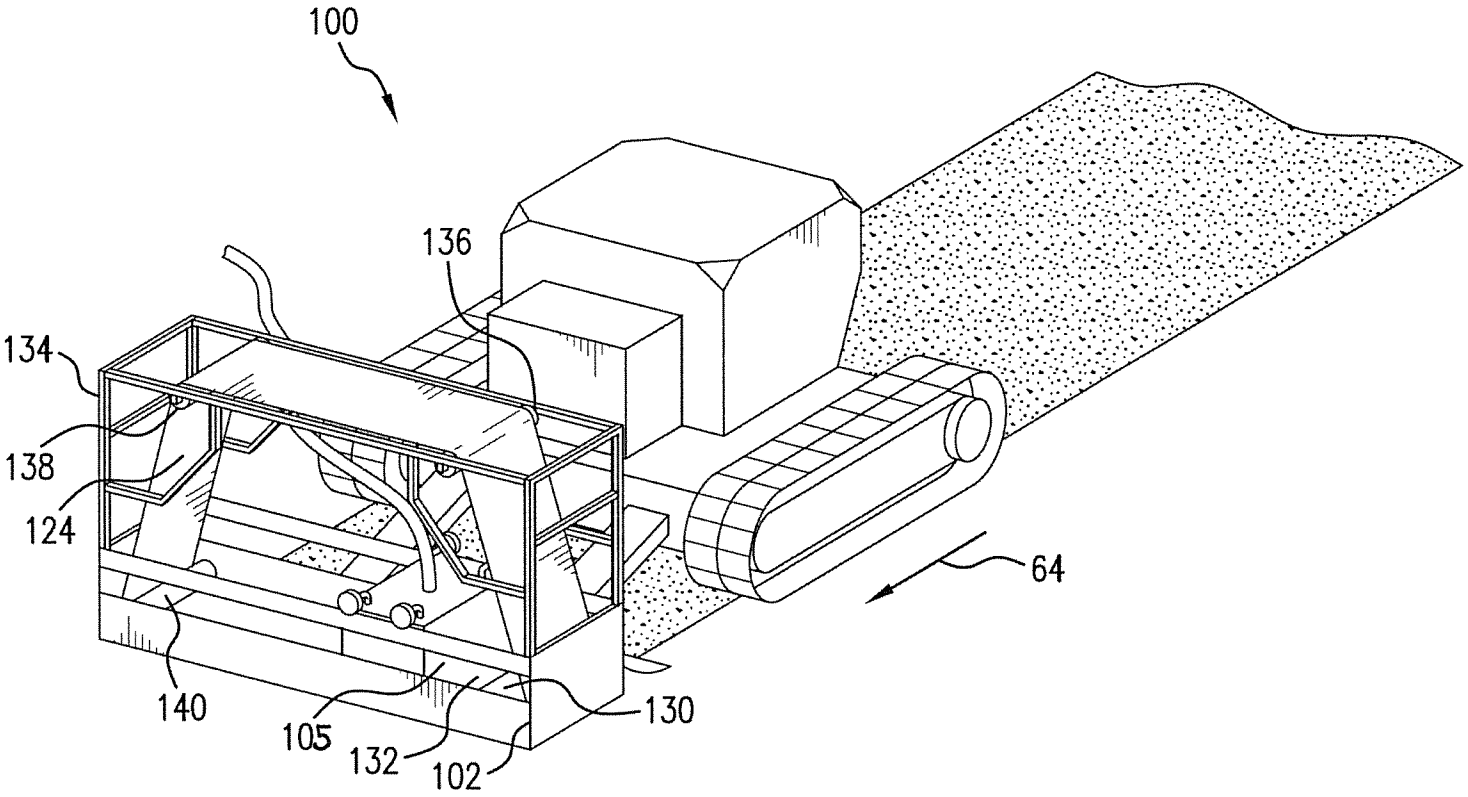
FIG. 4 is a front perspective view of the frame of a surface hydrodemolition apparatus according to the preferred embodiment of the invention.
Figure 5:
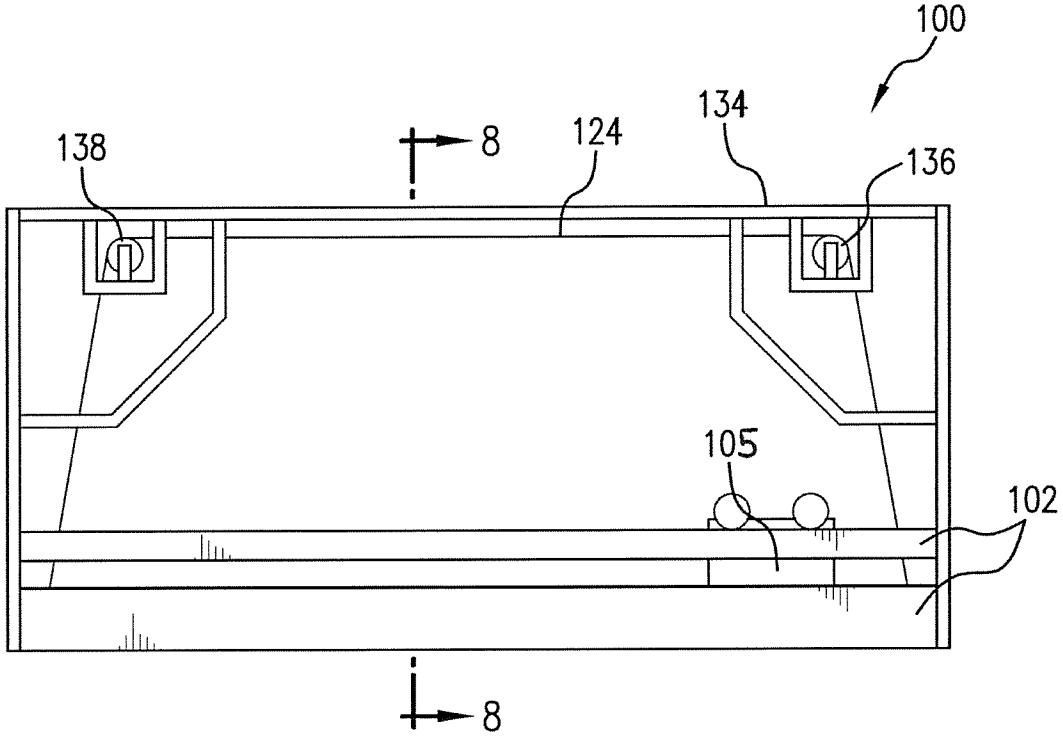
FIG. 5 is a front view of the embodiment of FIG. 4.
Figure 6:
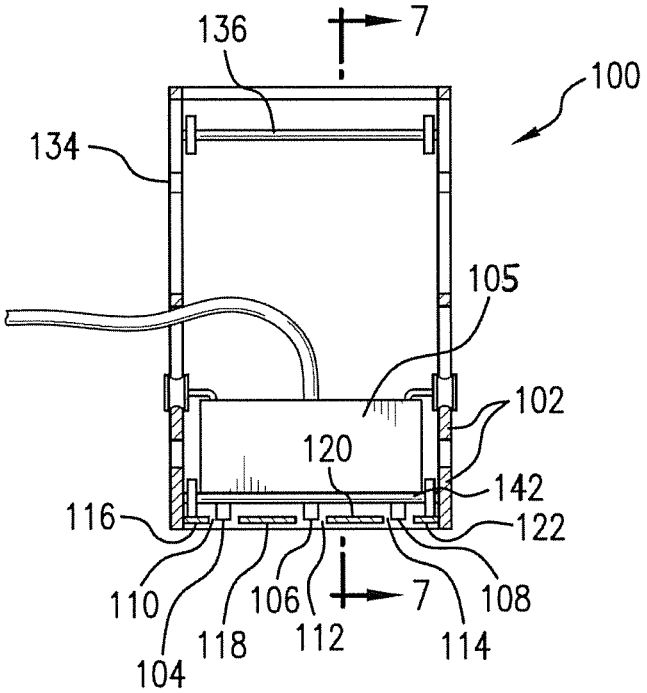
FIG. 6 is a side sectional view of the embodiment of FIG. 4 but with the loop belt removed for clarity.
Figure 7:
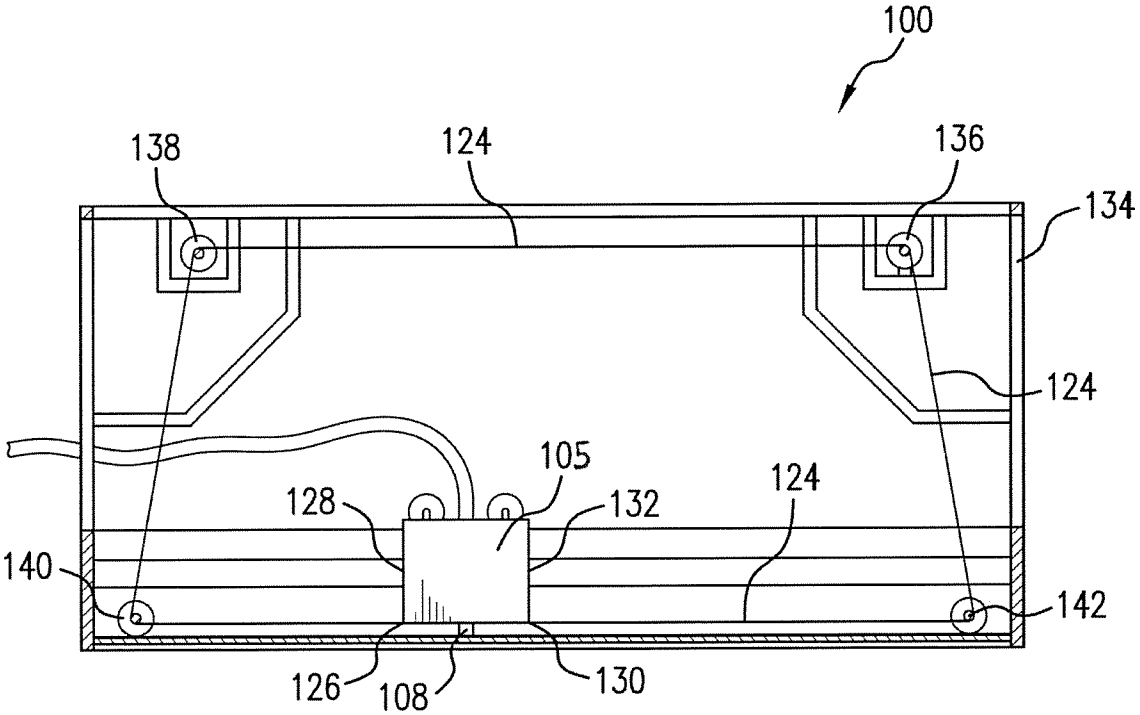
FIG. 7 is a view taken along line 7-7 of FIG. 6.
Figure 8:
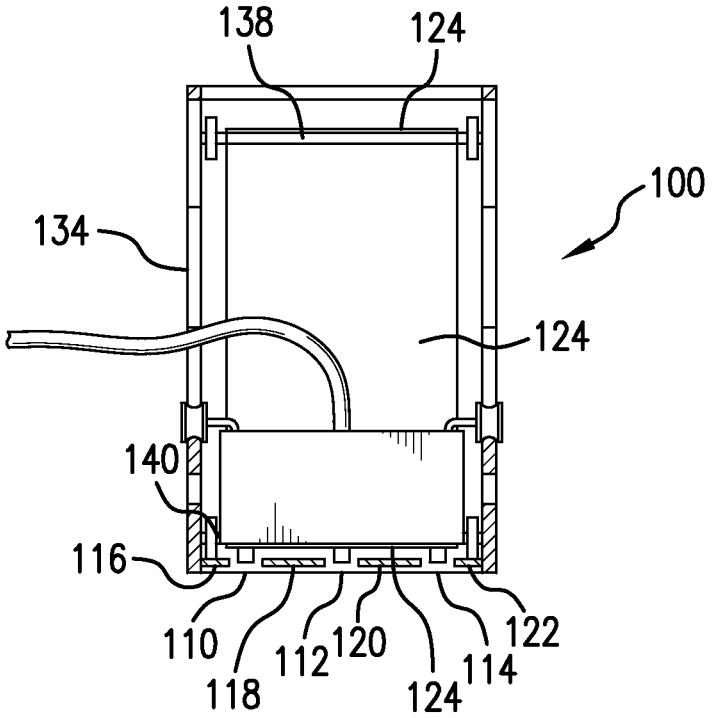
FIG. 8 is a view taken along line 8-8 of FIG. 5.

FIG. 4 shows the hydrodemolition apparatus 100 according to the preferred embodiment. It comprises a generally rectangular base frame 102 extending laterally in relation to the direction of travel 64 of the machine. A nozzle carrier 105 is mounted on the base frame 102 for reciprocation along the frame 102. A series of aligned nozzles 104, 106, 108 extend downward from the nozzle carrier 105 through gaps 110, 112, 114 between elongated base frame members 116, 118, 120, 122.

An elongated belt 124, preferably of rubber, has one end 126 attached to one side 128 of the nozzle carrier 105 while its other end 130 is attached to the opposite side 132 of the nozzle carrier. Belt 124 is of a sufficient width to completely cover the laterally adjacent gaps 110, 112, 114. As the nozzle carrier moves along the frame 102, it draws and pushes the attached ends 126, 130 of the belt 124 along with it. The balance of the belt 124 is supported by a supporting frame structure 134 extending over the base frame 102 such that the belt loops back from either side of the nozzle carrier 105 to the opposite side of the nozzle carrier. The balance of the belt 124 is otherwise unrestrained allowing movement along the frame structure upon the belt being pushed or pulled by the nozzle carrier.

Displacement of the belt 124 is facilitated by rollers 136, 138, 140 and 142 provided at the corners of the supporting frame structure 134.

The belt 124 does not comprise any apertures coinciding with the gaps 110, 112, 114 that might allow debris to be ejected from beneath the base frame 102.

The looping and attachment of the belt 124 to each side of the nozzle carrier 104 enables a push-pull effect to displace the belt along its length in either reciprocating direction.

The invention therefore effectively prevents any debris from being ejected vertically across the gaps 110, 112, 114 as the belt comprises a solid unapertured shield over the gaps while the body of the nozzle carrier 105 prevents the ejection of debris directly above the nozzles 104, 106, 108. The belt 124 further travels along with the nozzle carrier to provide uninterrupted shielding.

In its broadest aspect, the invention comprises a belt extending from one side of a nozzle carrier, along a carrier frame and looping back over the nozzle carrier to the opposite side of the nozzle carrier, the belt moving in response to movement of the nozzle carrier. While the preferred embodiment comprises a belt supporting structure extending above a base frame, a separately definable supporting structure is not strictly necessary so long as the belt loops to both ends of the nozzle carrier. For example, the belt may be supported by a portion of the base frame itself or by a removable or temporary structure, provided that any supporting structure is sufficiently rigid to effectively support the belt as it is displaced by the nozzle carrier.

According to the preferred embodiment, the ends of the belt are attached directly to the nozzle carrier. However, the ends may be attached to one or more intermediate structures that are in turn attached to the nozzle carrier.

According to the preferred embodiment, a single elongated belt loops between the sides of the nozzle carrier. However, it is contemplated that part of the loop may comprise cables or other means of attachment rather than full width belts in order to minimize the weight to be supported and displaced, provided only that the portion of the loop that overlays (at any time) the gaps between frame members are unapertured and extend substantially across the width of the base frame.

In the foregoing description, exemplary modes for carrying out the invention in terms of examples have been described. However, the scope of the claims should not be limited by those examples, but should be given the broadest interpretation consistent with the description as a whole. The specification and drawings are, accordingly, to be regarded in an illustrative rather than a restrictive sense.

The invention claimed is:

1. In a hydrodemolition apparatus comprising a frame having at least one gap therein, a nozzle carrier mounted for reciprocation along said frame, and at least one nozzle extending from said nozzle carrier through said at least one gap, wherein said nozzle carrier covers a portion of said at least one gap that directly underlies said nozzle carrier from time to time, a shield system comprising:

a belt extending from one side of said nozzle carrier, over said nozzle carrier and to an opposite side of said nozzle carrier;

a first end of said belt being secured to said one side of said nozzle carrier and an opposite end of said belt being secured to said opposite side of said nozzle carrier, said belt and said nozzle carrier defining a belt loop, said belt being otherwise unrestrained such that displacement of said nozzle carrier along said frame in a first direction urges said belt loop in a clockwise direction and displacement of said nozzle carrier along said frame in an opposite direction urges said belt loop in a counterclockwise; and, said belt having a width sufficient to completely cover said at least one gap during reciprocation of said nozzle carrier.

2. In a hydrodemolition apparatus comprising a frame having at least two adjacent gaps in said frame, a nozzle carrier mounted for reciprocation along said frame, and at least one nozzle extending downward from said nozzle carrier through each of said at least two adjacent gaps, wherein said nozzle carrier covers portions of said at least two adjacent gaps that directly underly said nozzle carrier from time to time, a shield system comprising:

a belt loop extending from one side of said nozzle carrier, over said nozzle carrier and to an opposite side of said nozzle carrier;

a first end of said belt loop being secured to said one side of said nozzle carrier and an opposite end of said belt loop being secured to said opposite side of said nozzle carrier, movement of said belt loop being otherwise unrestrained such that displacement of said nozzle carrier along said frame in a first direction urges said belt loop in a clockwise direction and displacement of said nozzle carrier along said frame in an opposite direction urges said belt loop in a counterclockwise direction; and, said belt loop being of a width sufficient to completely cover said at least two adjacent gaps during reciprocation of said nozzle carrier.

3. In a hydrodemolition apparatus having a frame, elongated gaps in said frame and a reciprocating nozzle carrier having nozzles carried by said nozzle carrier that extend through said elongated gaps to work an underlying surface, a shield system comprising a loop having ends secured to opposite sides of said reciprocating nozzle carrier, said loop overlaying portions of said elongated gaps that are not covered by said nozzle carrier from time to time during reciprocation of said nozzle carrier, and wherein said loop is urged by said nozzle carrier in a clockwise or counterclockwise direction according to the direction of travel of said nozzle carrier.

4. The shield system of claim 3 wherein said loop is supported by a supporting structure and wherein said supporting structure comprises rollers.

* * * * *